US011297881B2

(12) United States Patent
Qiu

(10) Patent No.: US 11,297,881 B2
(45) Date of Patent: Apr. 12, 2022

(54) HEATING MECHANISM, ATOMIZER AND ELECTRONIC CIGARETTE

(71) Applicant: Changzhou Patent Electronic Technology Co., LTD, Jiangsu (CN)

(72) Inventor: Weihua Qiu, Jiangsu (CN)

(73) Assignee: Changzhou Patent Electronic Technology Co., LTD, Changzhou (CN)

( * ) Notice: Subject to any disclaimer, the term of this patent is extended or adjusted under 35 U.S.C. 154(b) by 161 days.

(21) Appl. No.: 16/604,926

(22) PCT Filed: Nov. 30, 2017

(86) PCT No.: PCT/CN2017/114001
§ 371 (c)(1),
(2) Date: Oct. 11, 2019

(87) PCT Pub. No.: WO2018/188353
PCT Pub. Date: Oct. 18, 2018

(65) Prior Publication Data

US 2020/0163381 A1 May 28, 2020

(30) Foreign Application Priority Data

Apr. 14, 2017 (CN) ..... 201720392995.X

(51) Int. Cl.
*A24F 40/46* (2020.01)
*A24F 40/48* (2020.01)
(Continued)

(52) U.S. Cl.
CPC ..... *A24F 40/46* (2020.01); *A24F 40/44* (2020.01); *A24F 40/48* (2020.01); *A24F 40/485* (2020.01); *A24F 40/10* (2020.01)

(58) Field of Classification Search
CPC ..... A24F 40/10; A24F 40/40; A24F 40/44; A24F 40/46
(Continued)

(56) References Cited

U.S. PATENT DOCUMENTS 8,833,364 B2 * 9/2014 Buchberger ..... A61K 31/465 128/202.21
2013/0192623 A1 8/2013 Tucker et al.
(Continued)

FOREIGN PATENT DOCUMENTS

CN 203105624 U 8/2013
CN 204483030 U 7/2015
(Continued)

*Primary Examiner* — Hae Moon Hyeon
(74) *Attorney, Agent, or Firm* — Novick, Kim & Lee, PLLC; Allen Xue

(57) ABSTRACT

A heating mechanism of an electronic cigarette includes a heating member defining an airflow passage for airflow passing through; a liquid guiding member for absorbing and/or storing tobacco liquid for the heating member to perform an atomizing action; and a base seat, wherein both the heating member and liquid guiding member are assembled to the base seat. The base seat made of ceramic material can retain an atomizing temperature, causing the flavor of the next smoke to be same as the previous one smoke. Because the base seat made of ceramic material has a high temperate resistance, a flavor cannot be influenced by avoiding a dry-fried due to an appropriate assembly. Further, the base seat made of ceramic material can absorb a part or all the tobacco liquid condensed and received in the atomizing chamber, when the atomizer is used again, the fried oil can be avoided.

16 Claims, 10 Drawing Sheets

(51) Int. Cl.
*A24F 40/44* (2020.01)
*A24F 40/485* (2020.01)
*A24F 40/10* (2020.01)

(58) Field of Classification Search
USPC ..... 131/328, 329
See application file for complete search history.

(56) References Cited

U.S. PATENT DOCUMENTS

| | | | | |
|---|---|---|---|---|
| 2015/0059787 | A1* | 3/2015 | Qiu | H05B 3/14 131/329 |
| 2018/0049470 | A1* | 2/2018 | Chen | A24F 40/42 |
| 2019/0124994 | A1* | 5/2019 | Qiu | A24F 40/485 |
| 2019/0297946 | A1* | 10/2019 | Fu | A24F 40/44 |
| 2020/0015524 | A1* | 1/2020 | Rado | H05B 1/0244 |

FOREIGN PATENT DOCUMENTS

| | | | |
|---|---|---|---|
| CN | 105559149 | B | 5/2016 |
| CN | 106072767 | B | 11/2016 |
| CN | 205757193 | U | 12/2016 |

* cited by examiner

HEATING MECHANISM, ATOMIZER AND ELECTRONIC CIGARETTE

FIELD OF TECHNOLOGY

The disclosure relates to technical field electronic cigarette, and more particularly, relates to a heating mechanism, an atomizer and an electronic cigarette.

BACKGROUND

At present, the electronic cigarette is a mature alternative product for smoking in the market. The electronic cigarette provides power for the heating member of the atomizer by a battery, causing the heating member to be driven by electric and heat the tobacco liquid to generate aerosol for user's swallow.

However, in the related electronic cigarette, the atomizing base seat is generally made of solid metal material, when the metallic heating strip is powered on to generate heat, if the assembly of the metallic heating strip is not appropriate, and a contact between the metallic heating strip and the metallic base seat emerges, thus a dry-fried may occur. Further, when the electronic cigarette is not used for a time period, if it is used again, the tobacco liquid condensed in the atomizing chamber may be fried easily due to a heating, user's flavor and experience may be influenced.

SUMMARY

Accordingly, it is necessary to provide a heating mechanism for improving a swallow flavor and preventing oil fried.

It is further necessary to provide an atomizer having the heating mechanism.

It is further necessary to provide an electronic cigarette having the atomizer.

A heating mechanism includes a heating member, a liquid guiding member, and a base seat. The heating member defines an airflow passage for airflow passing through. The liquid guiding member is configured for absorbing and/or storing tobacco liquid for the heating member to perform an atomizing action. Both the heating member and liquid guiding member are assembled to the base seat.

Further, the base seat is made of ceramic material.

Further, the heating member is cylindrical heating strip, the liquid guiding member is wrapped around a periphery of the heating member, the heating member is positioned in the base seat in a transverse state and extends along an axial direction thereof, or the heating member is vertically positioned in the base seat along an axial direction of heating member.

Further, the base seat defines an airflow intake hole on an end, and an airflow outlet hole on an opposite end, the airflow passage is connected between the airflow intake hole and airflow outlet hole.

Further, the base seat forms an air intake end and a smoke outlet end, the smoke outlet end of the base seat forms a liquid gathering chamber, the heating member forms an aerosol generator passage therein, the aerosol generator passage of the heating member is in communication with the liquid gathering chamber.

Further, the liquid gathering chamber of the smoke outlet end of the base seat is the first liquid gathering chamber, the air intake end of the base seat is further provided with a detachable second liquid gathering chamber.

Further, the base seat includes a base portion, a blocking plate, and a latching plate, the blocking plate and the latching plate are positioned on opposite ends of the base portion, the blocking plate is detachably positioned on the air intake end of the base seat, the first liquid gathering chamber is positioned between the latching plate and the base portion, the second liquid gathering chamber is positioned between the blocking plate and the base portion.

Further, the base seat defines a liquid intake chamber which is recessed from the base seat, a bottom of the liquid intake chamber defines a plurality of oil guiding holes uniformly distributed, the plurality of oil guiding holes are in communication with the liquid guiding member.

Further, the bottom of the liquid intake chamber further defines a liquid intake hole, the liquid intake hole is positioned on a side of the bottom of the liquid intake chamber, the liquid intake hole extends to a bottom of the liquid guiding member.

An atomizer, includes any one of aforementioned heating mechanism; and a pair of electrode contact assemblies for providing electric drive for the heating mechanism.

Further, the atomizer further includes a sealing member and a main housing having an opening, the main housing defines a liquid storage chamber and a smoke outlet passage, the sealing member is assembled to the main housing via the opening, and the sealing member defines a liquid intake hole and a smoke outlet hole, which are in communication with the liquid storage chamber and the smoke outlet passage, respectively, the main housing is provided with a liquid injection mark and a sealing cover, the liquid intake mark is located on a position corresponding to the liquid intake hole, the sealing cover seals the liquid injection hole, the heating mechanism is assembled in the sealing member, and the base seat forms an atomizing chamber therein, the atomizing chamber is in communication with the liquid storage chamber and the smoke outlet passage.

Further, the smoke outlet passage is parallel to the liquid storage chamber, the sealing member defines an opening port in communication with the opening, an end of the heating mechanism is received in the sealing member, an opposite end of the heating mechanism is hermetically connected to the opening port.

Further, the smoke outlet passage is in communication with the airflow passage via a smoke guiding portion.

Further, an axial direction of the smoke outlet passage and an axial direction of the airflow passage defines an angle $\theta$, the angle $\theta$ has a value selected from $90<\theta<180$ degrees.

Further, an end of the smoke guiding portion in communication with the airflow passage has an internal diameter greater than an internal diameter of the airflow passage.

Further, the smoke guiding portion is positioned between the sealing member and a peripheral circumferential wall of a side of the base seat adjacent to the smoke outlet passage, and is in communication with the smoke outlet passage and the atomizing chamber, one of the two electrode contact assemblies which is adjacent to the smoke guiding portion defines a first through hole in communication with the atomizing chamber and the smoke guiding portion.

Further, the base seat includes a first end received in the sealing member and a second end hermetically connected to the opening port, the atomizing chamber cuts through the first end along an arranging direction of the liquid storage chamber and the smoke outlet passage, the heating member and the liquid guiding member are received in the atomizing chamber, and are aligned to and in communication with the liquid intake hole Further, the first end forms an assembly protrusion protruding from a side away from the second end, the assembly protrusion is detachably assembled in the liquid intake hole and defines a liquid intake port in communication with the liquid storage chamber and the atomizing chamber.

Further, the heating member wrapping around the liquid guiding member or the heating member wrapped by the liquid guiding member is assembled in atomizing chamber, one end of the two electrode contact assemblies are encapsulated in opposite ends of the atomizing chamber, and are electrically connected to the heating member, an opposite end of the two electrode contact assemblies extends through and protrudes out of the first end.

Further, the main housing defines an air intake hole, an inner chamber of the air intake hole forms an air intake passage, a side of the sealing member adjacent to the liquid storage chamber defines an air intake port in communication with the air intake passage, one of the two electrode contact assemblies which is adjacent to the air intake port defines a second through hole in communication with the air intake port.

Further, the sealing member is made of silica gel.

Further, an inner wall of the air intake hole is provided with an air regulating ring, the regulating ring is plugged into the inner wall of the air intake hole, the air regulating ring is provided with an air intake portion and an operation portion which are spaced from each other, the air intake portion cuts through the air regulating ring and defines a ventilation port in communication with the air intake hole.

An electronic cigarette, includes any one of aforementioned atomizer; and a battery electrically connected to the atomizer.

Further, the battery or the atomizer is provided with an elastic latch, the atomizer or the battery defines a latching groove accordingly, for securing the atomizer to the battery In the heating mechanism, the atomizer, and the electronic cigarette of the utility, the base seat made of ceramic material can retain an atomizing temperature, causing the flavor of the next smoke to be same as the previous one smoke. Because the base seat made of ceramic material has a high temperate resistance, a flavor cannot be influenced by avoiding a dry-fried due to an appropriate assembly. Further, the base seat made of ceramic material can absorb a part or all the tobacco liquid condensed and received in the atomizing chamber, when the atomizer is used again, the fried oil can be avoided.

Figure 1:
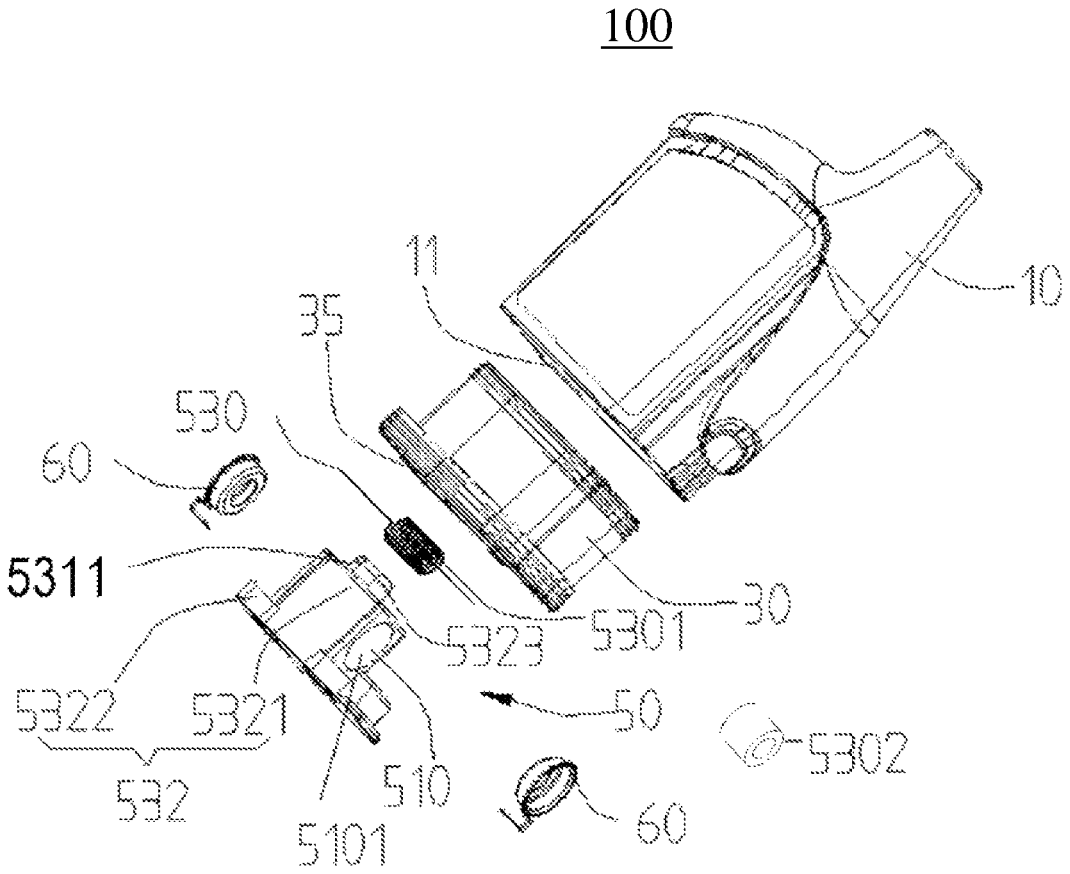
FIG. 1 is an exploded view of an atomizer according to a first embodiment.

| | |
|---|---|
| atomizer | 100 |
| heating mechanism | 50 |
| liquid storage chamber | 13 |
| liquid intake hole | 31 |
| atomizing chamber | 510 |
| airflow intake hole | 5101 |
| liquid intake port | 5311 |
| assembly protrusion | 5323 |
| smoke guiding portion | 70 |
| base portion | 38 |
| first liquid gathering chamber | 43 |
| liquid intake hole | 5325 |
| battery assembly | 90 |
| battery | 92 |
| air regulating ring | 191 |
| latching groove | 44 |
| main housing | 10 |
| electrode assembly | 60 |
| smoke outlet passage | 15 |
| smoke outlet hole | 33 |
| heating member | 530 |
| airflow outlet hole | 5102 |
| first end | 5321 |
| first through hole | 61 |
| air intake port | 37 |
| blocking plate | 39 |
| second liquid gathering chamber | 42 |
| electronic cigarette | 200 |
| elastic latch | 801 |
| charging interface | 93 |
| air intake portion | 1911 |
| air intake hole | 1913 |
| sealing member | 30 |
| opening | 11 |
| separating wall | 17 |
| opening port | 35 |
| base seat | 532 |
| airflow passage | 5301 |
| second end | 5322 |
| second through hole | 62 |
| air intake passage | 19 |
| latching portion | 40 |
| oil guiding hole | 5324 |
| housing | 80 |
| battery housing | 91 |
| power indicator light | 94 |
| operation portion | 1912 |
| liquid guiding member | 5302 |

DETAILED DESCRIPTION OF THE PREFERRED EMBODIMENT

Embodiments of the disclosure are described more fully hereinafter with reference to the accompanying drawings. The various embodiments of the disclosure may, however, be embodied in many different forms and should not be construed as limited to the embodiments set forth herein. Rather, these embodiments are provided so that this disclosure more clearly conveys the scope of the disclosure to those skilled in the art It should be noted that when an element is described as "fastened to" or "disposed on" another element, the element may be directly on the another element, or a mediate element may also exist; when an element is described as "connected to" another element, the element may be directly connected to the another element, or a mediate element may also exist Unless otherwise defined, all terms (including technical and scientific terms) used herein have the same meaning as commonly understood by one of ordinary skill in the art to which this disclosure belongs. The terms used herein in the specification of the present disclosure are for the purpose of describing the embodiments only and are not intended to limit the scope of the invention. As used herein, the term "and/or" includes any and all combinations of one or more of the associated listed items Referring to FIG. 1 and FIG. 2, according to a first embodiment of the disclosure, the atomizer 100 is electrically connected to a battery (see FIG. 7) to form an electronic cigarette. The atomizer 100 is electrically driven by the battery to heat the tobacco liquid, the tobacco liquid can be separately stored in one mechanism. The mechanism is configured to be in communication with the atomizer 100, for providing tobacco liquid for the atomizer 100, or, the tobacco liquid is directly stored in the atomizer 100, for forming aerosol to be inhaled by a user.

The atomizer 100 includes a main housing 10 having an opening 11, a sealing member 30, a heating mechanism 50, and a pair of electrode assemblies 60. The main housing 10 defines a liquid storage chamber 13 and a smoke outlet passage 15 spaced from the liquid storage chamber 13. The sealing member 30 is assembled to the main housing 10 via the opening 11, and the sealing member 30 defines a liquid intake hole 31 and a smoke outlet hole 33, which are in communication with the liquid storage chamber 13 and the smoke outlet passage 15 respectively, i.e. the liquid intake hole 31 is in communication with the liquid storage chamber 13, the smoke outlet hole 33 is in communication with the smoke outlet passage 15. The main housing 10 is provided with a liquid injection mark (not shown) and a sealing cover (not shown), the liquid intake mark is located on a position corresponding to the liquid intake hole 31. The sealing cover seals the liquid intake hole 31. The heating mechanism 50 is assembled in the sealing member 30, and forms an atomizing chamber 510 therein, the atomizing chamber 510 is in communication with the liquid storage chamber 13 and the smoke outlet passage 15. Exemplarily, the tobacco liquid stored in the liquid storage chamber 13 flows into the atomizing chamber 510 via the liquid intake hole 31, when the atomizer 100 is powered on, the tobacco liquid flowing into the atomizing chamber 510 is atomized by the heating mechanism 50. After the aerosol is formed, the aerosol flows into the smoke outlet passage 15 via the smoke outlet hole 33, under a sucking action or a pump action, the aerosol is inhaled by a user.

Figure 2:
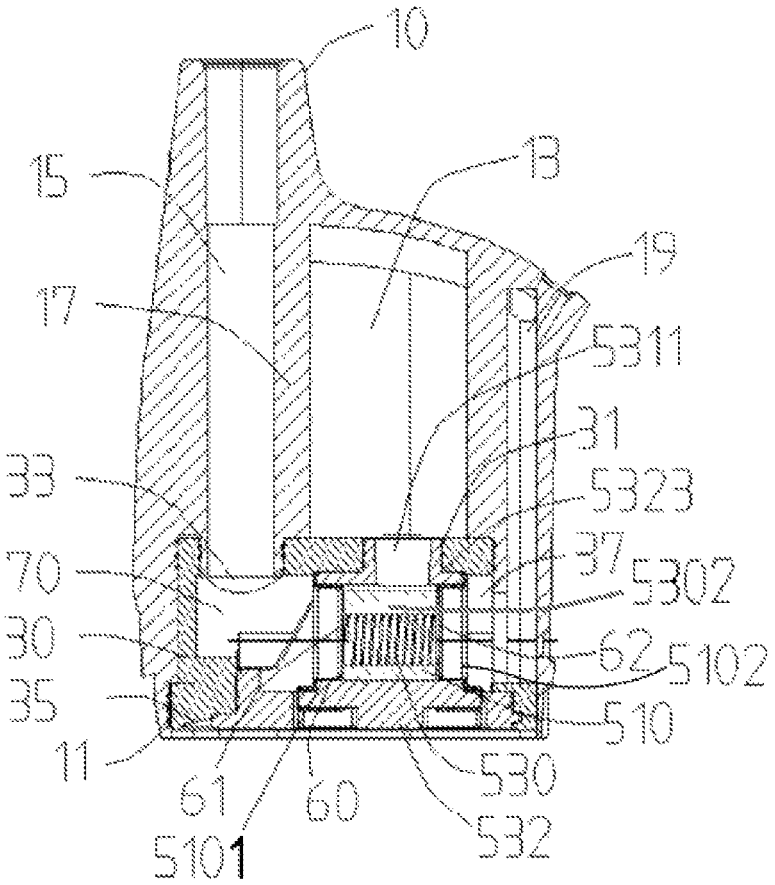
FIG. 2 is a cross-sectional view of the atomizer of FIG. 1.

Specifically referring to FIG. 2, the main housing 10 substantially has a hollow shape, and houses the sealing member 30 via the opening 11. The main housing 10 defines an outlet hole on an end opposite to the opening 11, for the aerosol flowing out. The main housing 10 forms a separating wall 17 on an inner side surface, the separating wall 17 extends along a longitudinal direction. The inner chamber of the main housing 10 is divided by the separating wall 17 into the liquid storage chamber 13 and the smoke outlet passage 15. According to an embodiment, both the liquid storage chamber 13 and the smoke outlet passage 15 extend along a longitudinal direction and are parallel to each other.

The sealing member 30 defines an opening port 35 in communication with the opening 11. In the illustrated embodiment, an end of the sealing member 30 opposite to the opening port 35 is detachably positioned on the inner wall and the separating wall 17 of the main housing 10, and the sealing member 30 defines the liquid intake hole 31 in communication with the liquid storage chamber 13 and the smoke outlet hole 33 in communication with smoke outlet passage 15. The assembly mode of the sealing member 30 in the main housing 10 is determined according to a requirement, for example latching or interference fit, if only the sealing member 30 can be detachably attached to the main housing 10, which is not limited hereby.

According to an embodiment, the sealing member 30 is made of silica gel formed by hot pressing, it has an elastic deformation performance, which facilitates for an assembly of the sealing member 30 and a sealing performance is enhanced.

Specifically referring to FIG. 1, an end of the heating mechanism 50 is received in the sealing member 30, an opposite end of the heating mechanism 50 is hermetically connected to the opening port 35, causing the heating mechanism 50 to be hermetically assembled to the main housing 10 via the sealing member 30. The heating mechanism 50 includes a heating member 530, a liquid guiding member 5302 and a base seat 532.

Specifically, the heating member 530 defines an airflow passage 5301 for the airflow passing through, the liquid guiding member 5302 is configured for absorbing and/or storing the tobacco liquid for the heating member 530 to perform an atomizing action. Both the heating member 530 and the liquid guiding member 5302 are assembled in the base seat 532. In the illustrated embodiment, the heating member 530 is a cylindrical heating strip, the liquid guiding member 5302 is wrapped around a periphery of the heating member 530. The heating member 530 is positioned in the base seat 532 in a transverse state and extends along an axial direction thereof. The base seat 532 defines an airflow intake hole 5101 on an end, and an airflow outlet hole 5102 on an opposite end, the airflow passage 5301 is connected between the airflow intake hole 5101 and airflow outlet hole 5102.

The Second Embodiment

Figure 6:
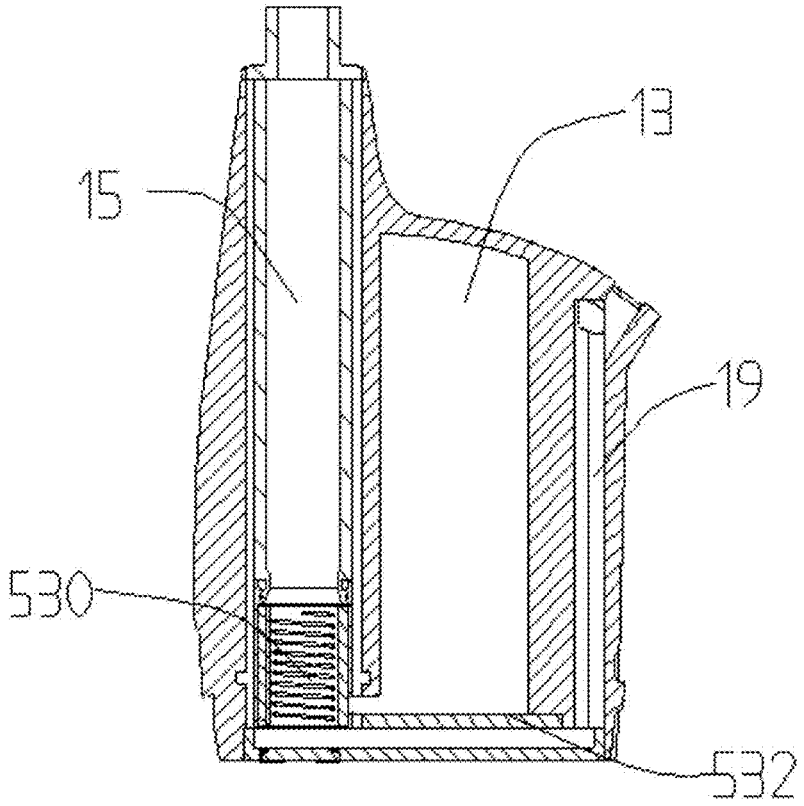
FIG. 6 is a cross-sectional view of the atomizer of a second embodiment.

As shown in FIG. 6, according to an alternative embodiment, the heating member 530 can be vertically positioned in the base seat 532 along an axial direction of heating member 530.

The base seat 532 includes a first end 5321 received in the sealing member 30 and a second end 5322 hermetically connected to the opening port 35. The atomizing chamber 510 cuts through the first end 5321 along an arranging direction of the liquid storage chamber 13 and the smoke outlet passage 15. The heating member 530 and the liquid guiding member 5302 are received in the atomizing chamber 510, and are in communication with the liquid intake hole 31, causing the tobacco liquid in the liquid storage chamber 13 to flow into the atomizing chamber 510 via the liquid intake hole 31.

According to an embodiment, the first end 5321 forms an assembly protrusion 5323 protruding from a side away from the second end 5322. The assembly protrusion 5323 is detachably assembled in the liquid intake hole 31 and defines a liquid intake port 5311 (as shown in FIG. 2) in communication with the liquid storage chamber 13 and the atomizing chamber 510, causing the heating mechanism 50 to be detachably assembled in the sealing member 30, the heating mechanism 50 hermetically engages the sealing member 30 via the second end 5322.

It can be understood that, in alternative embodiment not shown, an encapsulating member can be provided in the liquid intake hole 31. When the heating mechanism 50 is not assembled, due to the encapsulating member, the tobacco liquid in the liquid storage chamber 13 can be encapsulated. Therefore, it facilitates for transportation and replacement. When the heating mechanism 50 is assembled in place, the assembly protrusion 5323 can resist and pierce the encapsulating member, causing the liquid intake port 5311 to be in communication with the liquid intake hole 31.

In the illustrated embodiment, a cross-section of the base seat 532 substantially has a T shape, the first end 5321 has a size less than that of the second end 5322. The second end 5322 has a size matching a size of the opening port 35 in the sealing member 30. Specifically, in the illustrated embodiment, the cross-section of the first end 5321 has a width less than that of a cross-section of the second end 5322. Accordingly, a smoke guiding portion 70 (as shown in FIG. 2) is formed between a peripheral circumferential wall of a side of the first end 5321 adjacent to the smoke outlet passage 15 and a corresponding side of the sealing member 30, the smoke guiding portion 70 is positioned between and in communication with the smoke outlet passage 15 and the atomizing chamber 510, enabling the aerosol generated in the atomizing chamber 510 to flow into the smoke outlet passage 15 via the smoke guiding portion 70, for the user to inhale. The smoke guiding portion 70 has a relative long passage perpendicular to the smoke outlet passage 15, and the passage is not in communication with the smoke outlet passage 15 by a straight though communication, thus, it is equivalent to form a bending portion, the atomized smoke can be blocked by the bending portion to some extent, the tobacco liquid not be atomized fully can be detained in the bending portion, inhaling the tobacco liquid directly by user can be avoided. In addition, due to the bending portion, the speed of the airflow flowing into the user's mouth is not high enough, user cannot be choked by the airflow, the flavor can further be improved. In the illustrated embodiment, the airflow passage 5301 is in communication with the smoke outlet passage 15 via the atomizing chamber 510. It can be understood that, in alternative embodiment not shown, the airflow passage 5301 can be in communication with the smoke outlet passage 15 directly.

It can be concluded that, due to the smoke guiding portion 70, an axial direction of the smoke outlet passage 15 and an axial direction of the airflow passage 5301 defines an angle θ, the angle θ is 90 degrees. It can be understood that, in alternative embodiment not shown, the angle θ can be other values: $0° < \theta < 90$ degrees, or $90 < \theta < 180$ degrees.

It can be understood that, in alternative embodiment not shown, other structures can be configured to reduce the flowing speed of the aerosol. For example, an end of the smoke guiding portion 70 in communication with the airflow passage 5301 has an internal diameter greater than an internal diameter of the airflow passage 5301. It can be understood that, the suddenly increase of the internal diameter cause a reduction of the flowing speed of the airflow. It can be understood that, any one of aforementioned two methods for reducing the airflow speed can be selected, and alternatively, the two methods can be used the same time.

Further, the base seat 532 can be made from materials having a high temperature resistance and cannot be deformed easily, for example, ceramic materials. The base seat 532 made of ceramic material can retain an atomizing temperature, causing the flavor of the next smoke to be same as the previous one smoke. When the atomizer 100 is not used for a certain time period, the base seat 532 made of ceramic material can absorb a part or all the tobacco liquid condensed and received in the atomizing chamber 510. When the atomizer 100 is used again, the fried oil can be avoided. It can be understood that, compared to other high temperature resistance material, the ceramic material has a low cost, which facilitate for lowering down the cost.

The two electrode assemblies 60 are encapsulated in opposite ends of the atomizing chamber 510, and are electrically connected to the heating member 530. Taking one electrode assembly 60 for example, an end of the electrode assembly 60 serves as a part encapsulating the atomizing chamber 510 (not encapsulating completely, the end has an annular shape, a though hole is defined on a middle for assembling the heating member 530 into the atomizing chamber 510), an opposite end extends through and protrudes out of the second end 5322, and is thereby electrically connected to one electrode of the battery located out of the atomizer 100.

Referring to FIG. 2, preferably, the main housing 10 defines an air intake hole (See FIG. 9), the inner chamber of the air intake hole 1913 forms an air intake passage 19 in communication with an area outside the atomizer 100, a side of the sealing member 30 adjacent to the liquid storage chamber 13 defines an air intake port 37 in communication with the air intake passage 19. The electrode contact assembly 60 adjacent to the smoke guiding portion 70 defines a first through hole 61 in communication with the atomizing chamber 510 and the smoke guiding portion 70. The electrode assembly 60 adjacent to the air intake port 37 defines a second through hole 62 in communication with the air intake port 37. At the time, the external airflow flows into the air intake passage 19, it enters into the atomizing chamber 510 by passing through the air intake port 37 and the second through hole 62 successively, the airflow enters into the smoke guiding portion 70 via the first through hole 61 accompanying with the aerosol in the atomizing chamber 510, the aerosol in the smoke guiding portion 70 is mixed with the external airflow, and flows into the smoke outlet passage 15 via the smoke outlet hole 33, drawn by the smoker, the aerosol flows into user's mouth to be inhaled.

Figure 3:
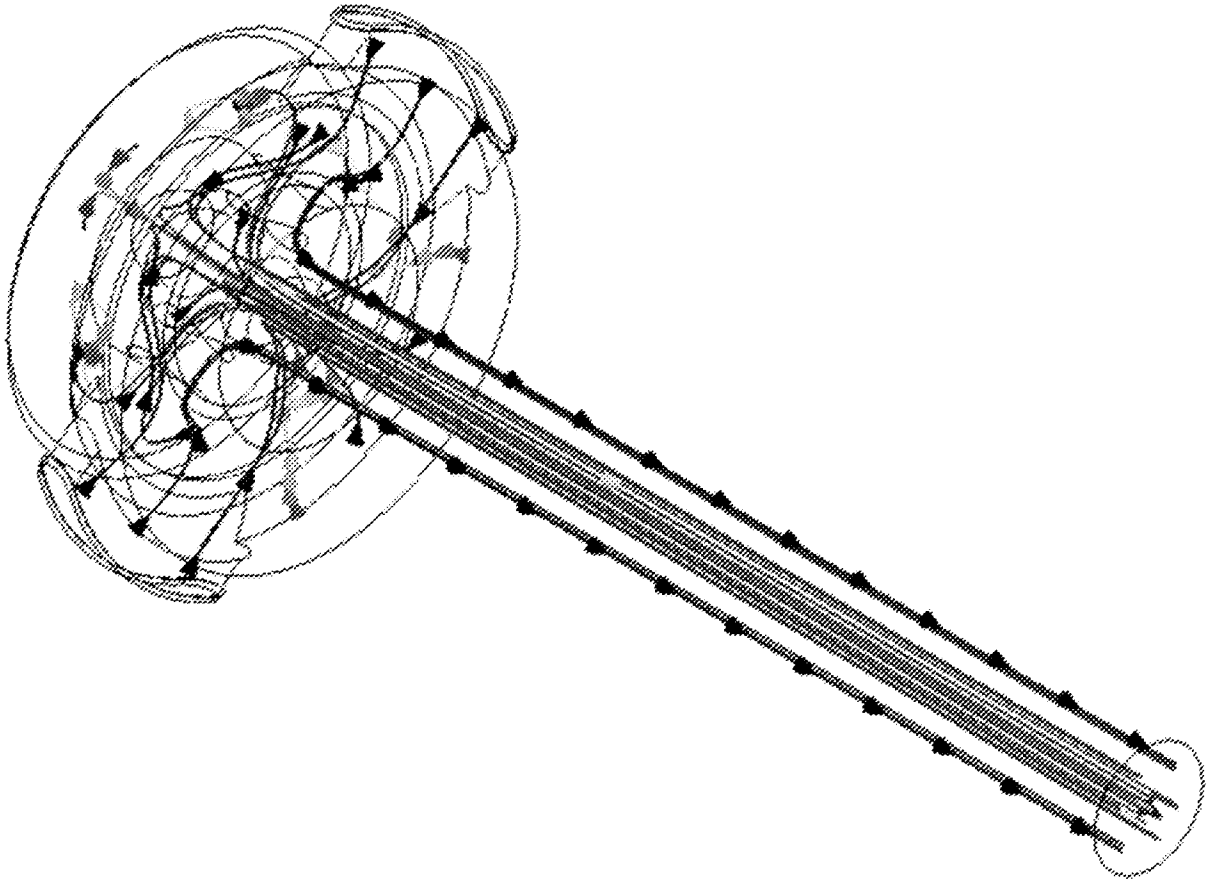
FIG. 3 Prior Art
FIG. 3 is a simulation diagram of an airflow state of an atomizer of the prior art.

Referring to FIG. 3, FIG. 3 is a simulation diagram showing an airflow state in the atomizer of prior art. It can be seen that, the aerosol atomized and formed in the airflow outlet end flows out with a high speed, user inhales with a bit force, great aerosol can emerge. For user's smoke operation, it can be chocked easily due to an overload amount of aerosol. Furthermore, the aerosol rushes out with a high speed, for user, the mouth can be burned.

Figure 4:
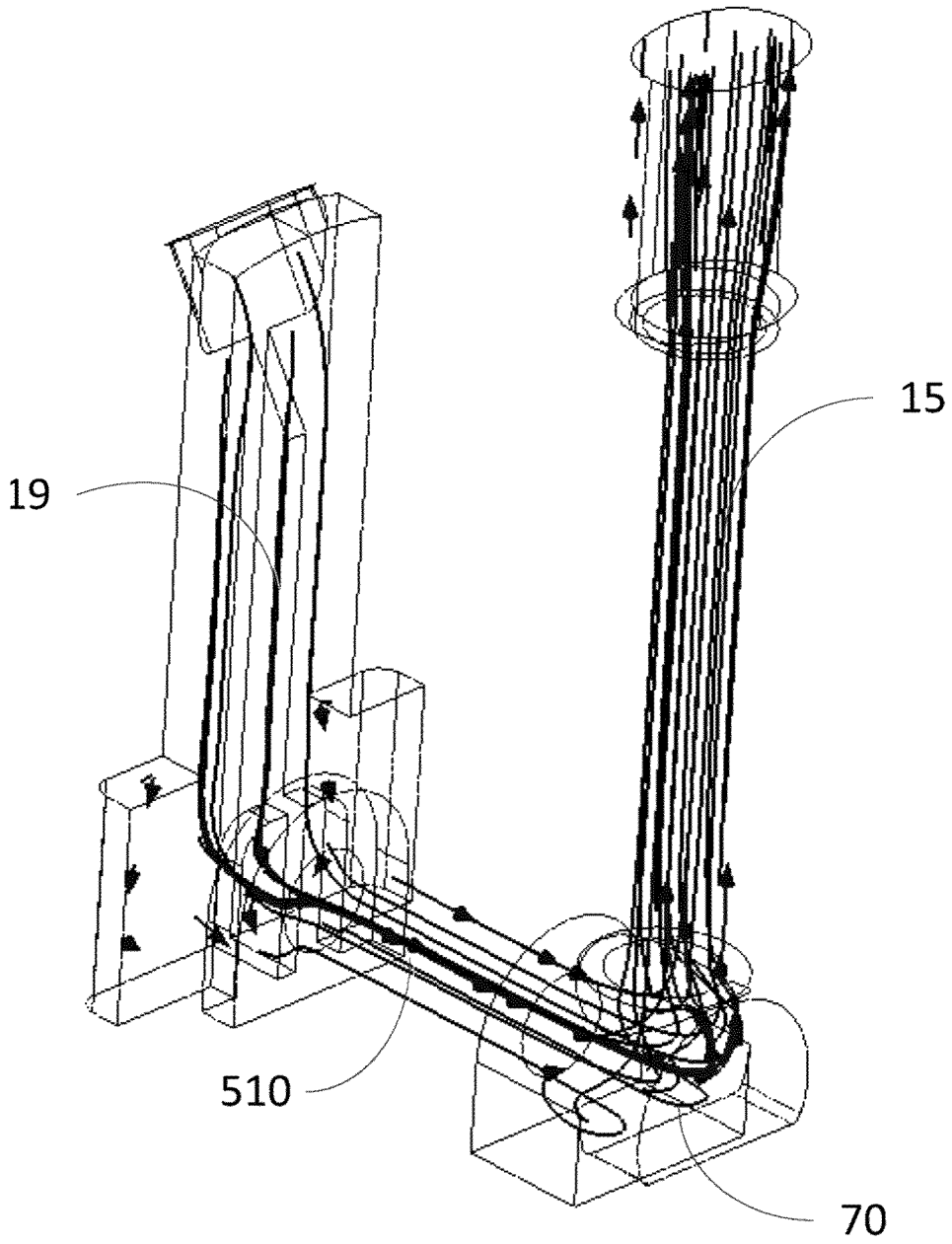
FIG. 4 is a simulation diagram of an airflow state of the atomizer of the embodiment.
Figure 5:
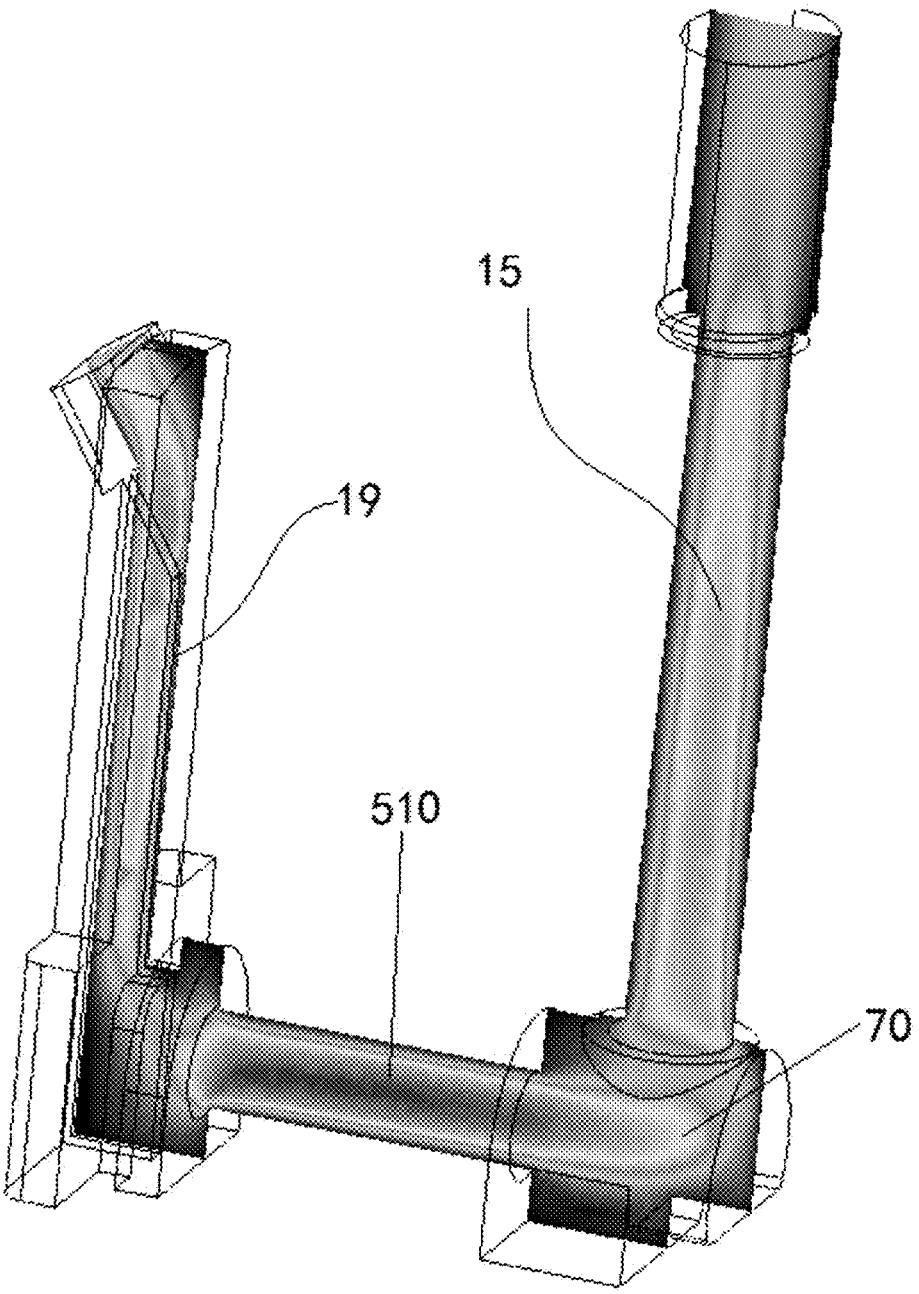
FIG. 5 is a simulation diagram of an airflow speed state of the atomizer of the embodiment.

Referring to FIG. 4 and FIG. 5, a simulation diagram of the airflow state and a simulation diagram of the aerosol flowing speed state are shown respectively. It is apparently, referring to FIG. 4, the external airflow flows into the atomizer 100, and is mixed with the aerosol generated by heating and atomizing, in the flowing out process, due to the smoke guiding portion 70, a turbulent and mixture process is existed in the airflow. In the process, the speed of the aerosol is reduced, and it can retard some tobacco liquid particle having a larger volume which are not fully atomized and mingled in the airflow. Specifically, referring to FIG. 5 (the darker the area, the heavier the color, the higher the airflow speed). FIG. 5 shows a simulation diagram of the airflow state of the atomizer 100 according to the illustrated embodiment. It is apparently that, the atomizer 100 according to the embodiment has three flowing speed stage, i.e. the air intake stage, the atomizing stage and the air outlet stage. The air speed in the air intake stage and the air speed of the air outlet stage are obviously less than that of the atomizing stage, i.e. when the airflow entering into the atomizer 100 from outside passes through the atomizing stage (the heating member 530), it has a relative high speed. One advantage is that, the airflow can take away the atomized aerosol rapidly, the liquid dropping speed in the liquid storage chamber 13 is increased, the liquid gathering can be avoided. The dry-fire can be avoided, similarly, the speed of the aerosol mixed with the aerosol and external airflow can be reduced when it encounters the smoke guiding portion 70, it then enters into the air outlet stage, in the stage, due to the prior smoke guiding portion 70, the speed of the aerosol can be reduced for user's normal swallow. Because the flowing speed is not high enough, the choking situation by the aerosol can be reduced, the flavor for user is improved. Further, because the flowing speed of the airflow is reduced, it means that the aerosol takes more time to reach user's mouth, therefore, the aerosol can be cooled to a suitable temperature, the user's mouth cannot be burned by the aerosol easily. Further, generally speaking, the speed of the central airflow is greater than that of the peripheral airflow, by reducing the speed, the speeds of the internal area and the external area can remain constituent, thus the flavor of the aerosol can be improved.

Referring to FIG. 2 again, in the assembly process, the end of the sealing member 30 having the liquid intake hole 31 and the smoke outlet hole 33 is assembled in the main housing 10 first. The opening port 35 of the sealing member 30 is received in the opening 11 or is aligned to the opening 11, at the time, the main housing 10 and the sealing member 30 are integrally assembled. The heating member 530 wrapping around the liquid guiding member 5302 or the heating member 530 wrapped by the liquid guiding member 5302 is assembled in the base seat 532, the two electrode assemblies 60 are pressed into opposite ends of the atomizing chamber 510 of the base seat 532, respectively, at the time, the heating mechanism 50 are assembled in the form of module. The assembled heating mechanism 50 are assembled in the assembled main housing 10 of the sealing member 30, an assembly of the whole atomizer 100 is accomplished, it has a simple structure and facilitates for assembly.

The disclosure further provides an electronic cigarette having the atomizer 100.

The Third Embodiment

Referring to FIG. 7 through FIG. 10, the third embodiment of the disclosure provides an electronic cigarette 200. The electronic cigarette 200 includes an atomizer 100, a housing 80, and a battery assembly 90. The battery assembly 90 is received in the housing 80 and is electrically connected to the atomizer 100.

The differences between the atomizer 100 of the third embodiment and the atomizer 100 of the second embodiment are that: the inner wall of the air intake hole 1913 is provided with an air regulating ring 191, the regulating ring 191 is rotatably plugged into the external wall of the air intake hole 1913. The air regulating ring 191 has an annular structure. The air regulating ring 191 is provided with an air intake portion 1911 and an operation portion 1912 which are spaced from each other. The air intake portion 1911 cuts through the air regulating ring 191, the inner hole of the air intake portion 1911 is in communication with the air intake hole 1913, the operation portion 1912 is a groove. The air regulating ring 191 is rotated to cause the air intake portion 1911 of the air regulating ring 191 to rotate relative to the air intake hole 1913, when the air intake portion 1911 of the air regulating ring 191 is staggered from the air intake hole 1913 completely, the air intake passage 19 is closed from outside. When the air intake portion of the air regulating ring 191 is partly overlapped with the air intake hole 1913, at the time, the air intake passage 19 is opened and in communication with outside, by a rotation of the operation portion 1912 of the air regulating ring 191, an overlapping area between the air intake portion 1911 and the air intake hole 1913 can be controlled, thus an air intake volume can be adjusted.

Figure 9:
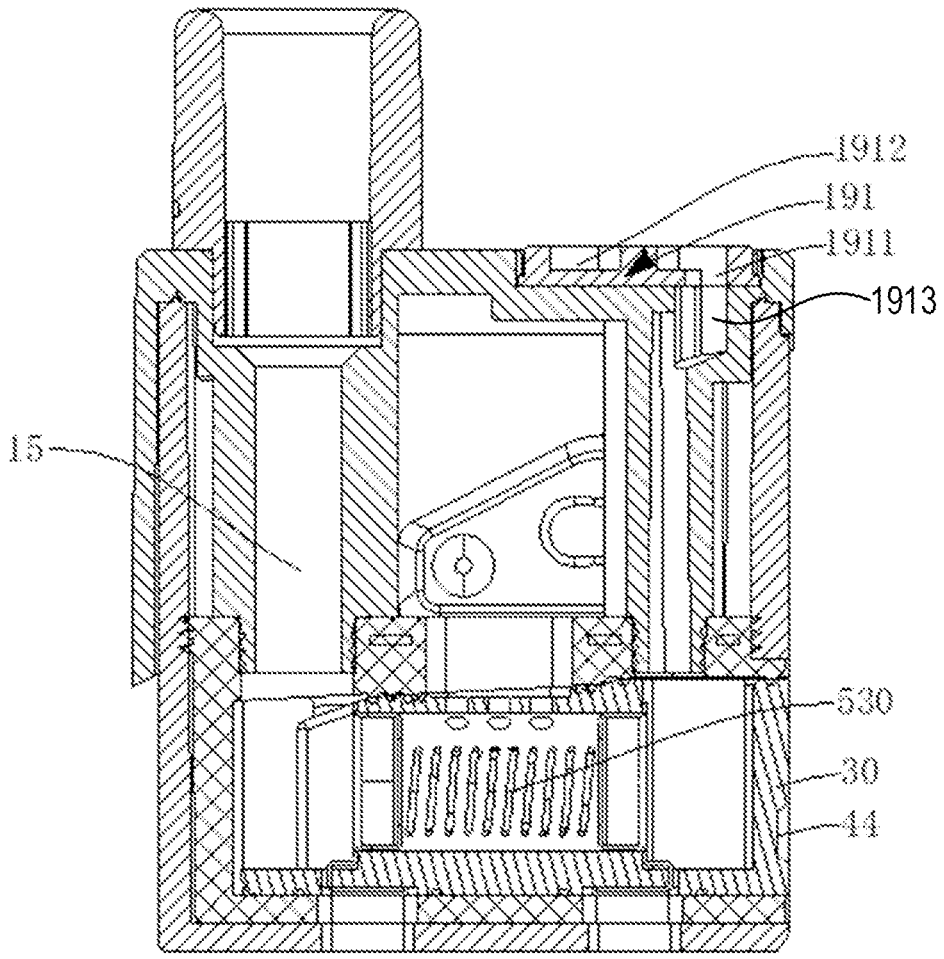
FIG. 9 is an isometric view of the internal structure of the atomizer of the electronic cigarette of FIG. 8.
Figure 10:
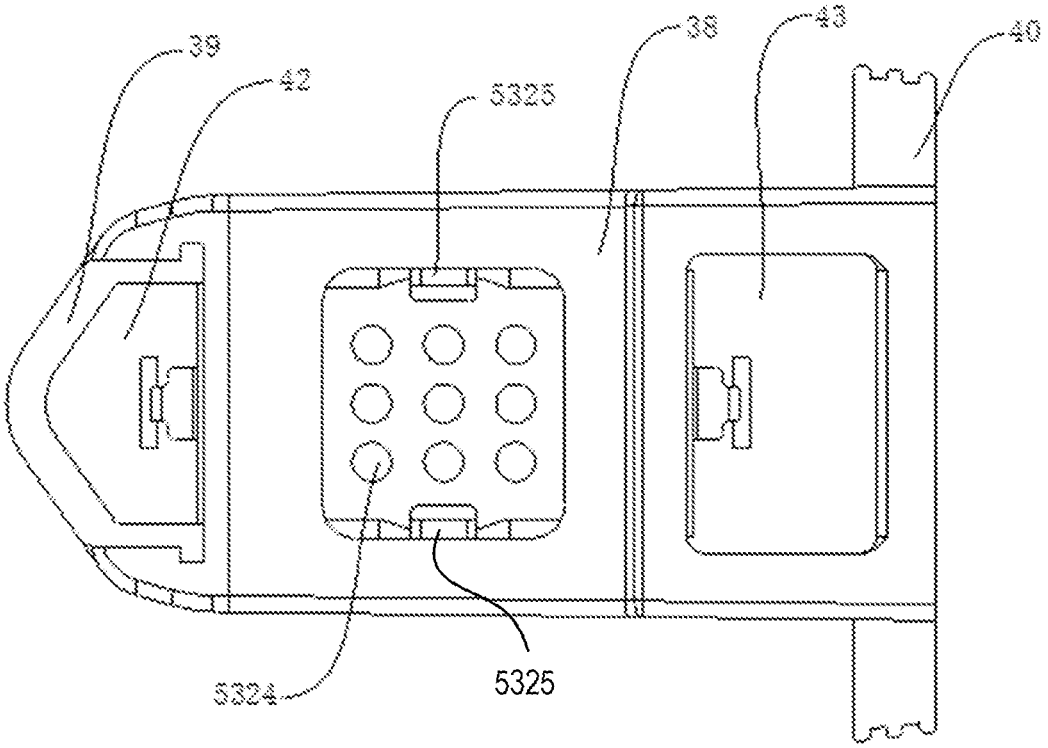
FIG. 10 is a top view of the electronic cigarette of FIG. 8, after an assembly of a sealing member and a heating mechanism.

The sealing member 30 is plugged into the sidewall of the atomizer 100, the sealing member 30 can be dragged out from the sidewall of the atomizer 100. The base seat includes a base portion 38, a blocking plate 39, a latching plate 40, and a latching groove 44. The blocking plate 39 and the latching plate 40 are positioned on opposite ends of the base portion 38. The latching groove 44 is recessed from a side of the base portion 38 away from the blocking plate 39. The base seat 532 forms two liquid gathering chambers spaced form each other. The two gathering chambers includes a first liquid gathering chamber 43 and a second liquid gathering chamber 42. The blocking plate 39 is latched on the base portion 38. The first liquid gathering chamber 43 is positioned between the latching plate 40 and the base portion 38. The second liquid gathering chamber 42 is positioned between the blocking plate 39 and the base portion 38. The first liquid gathering chamber 43, the second liquid gathering chamber 42 are in communication with the base seat 532. According to an embodiment, the second liquid gathering chamber 42 is formed after the blocking plate 39 assembled to the base portion 38. The first liquid gathering chamber 43 is formed on the latching plate 40 which is integrally formed on a side of the base portion 38, the first liquid gathering chamber 43 is inherent. Referring to FIGS. 9 and 10, the first liquid gathering chamber 43 is positioned on the smoke outlet end of an atomizing core, i.e. wherever the atomizing core positioned, the first liquid gathering chamber 43 of the smoke outlet end of is inherent. Because the atomizing core shown in the embodiment is transverse, it merely atomizes the tobacco liquid but does not absorb the aerosol, the aerosol may flow from the left side and the right side, thus when the second liquid gathering chamber 42 is formed by installing the blocking plate 39, the liquid gathering phenomenon in the air intake end of the atomizing core can be relieved.

The heating member 530 is received in the base seat 532, the liquid guiding member 5302 is sleeved on the heating member 530, the base seat 532 further defines a liquid intake chamber (not shown) which is recessed from the base seat 532 and in communication with the liquid storage chamber 13. The bottom of the liquid intake chamber defines a plurality of oil guiding holes 5324 uniformly distributed. The bottom of the liquid intake chamber further defines two liquid intake holes 5325. The two liquid intake holes 5325 are positioned on opposite sides of the liquid intake chamber, respectively, the liquid intake hole 5325 extends toward the bottom of the liquid guiding member 5302 along the sidewall of an assembly chamber.

Figure 7:
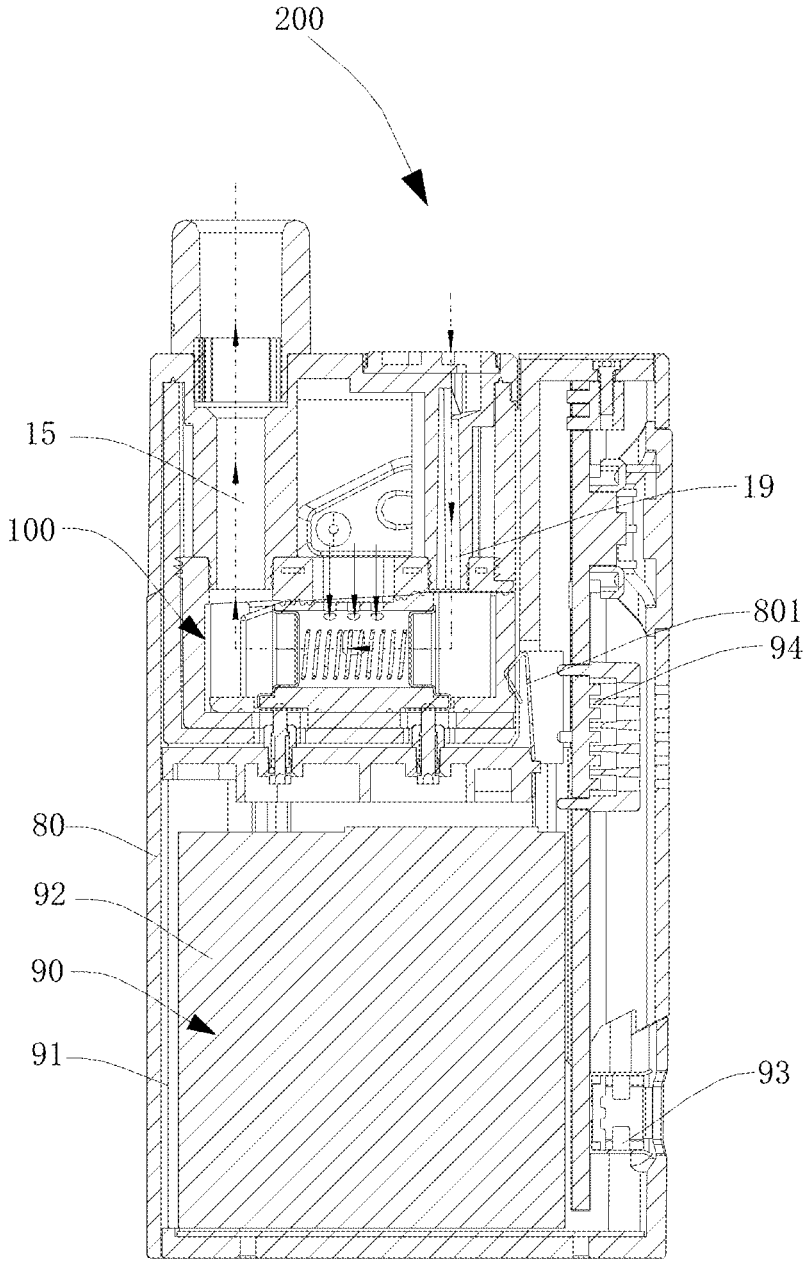
FIG. 7 is an isometric view of the structure of an electronic cigarette according to a third embodiment.
Figure 8:
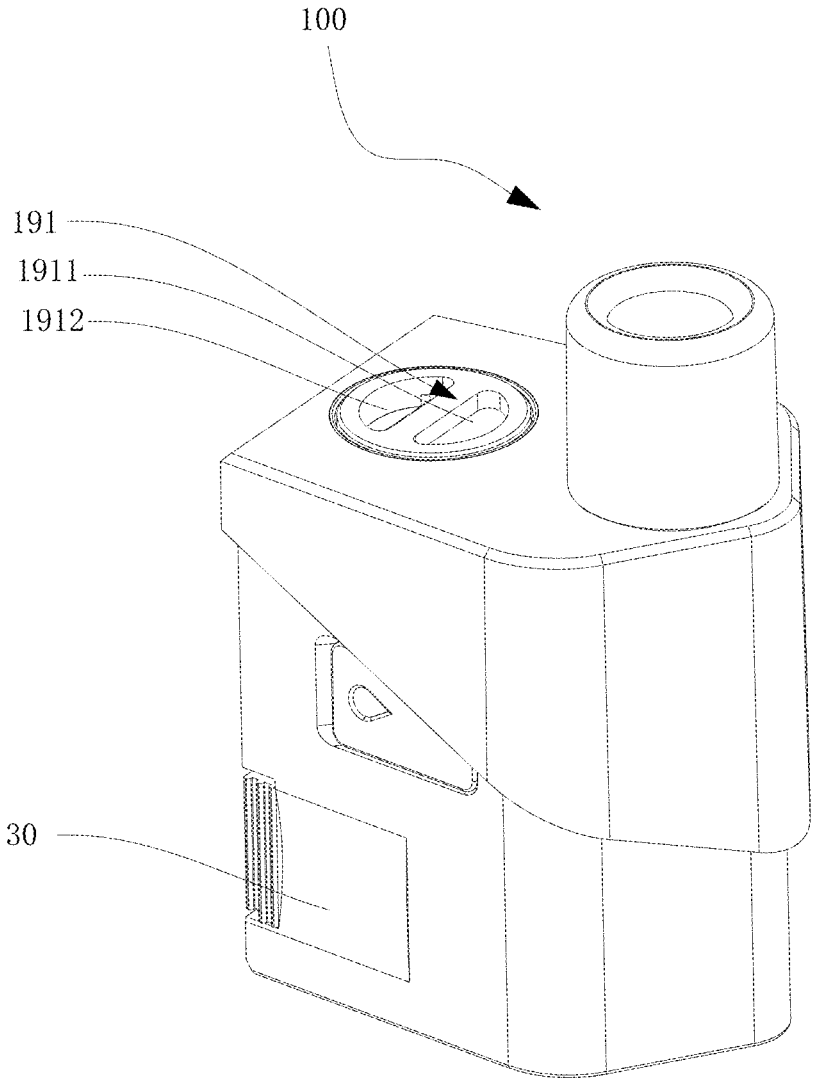
FIG. 8 is an isometric view of the structure of an atomizer of the electronic cigarette of FIG. 7.

Referring to FIG. 7 and FIG. 8, the atomizer 100 is provided with a latching groove 44, the battery assembly 90 is provided with an elastic latch 801 corresponding to the latching groove 44. The atomizer 100 is fixed in the housing 80 of the electronic cigarette 200 by the elastic latch 801, it facilitates for assembling and disassembling, and a departure of the atomizer 100 from the battery assembly 90 can be avoided. In an alternative embodiment not shown, the positions of the elastic latch 801 and the latching groove 44 can be exchanged, i.e. the elastic latch 801 is positioned on the atomizer 100, and the latching groove 44 is positioned on the battery assembly 90.

The battery assembly 90 includes a battery housing 91, a battery 92 received in the battery housing 91, a charging interface 93 and a power indicator light 94 positioned on a side of the battery housing 91. The battery 92 is electrically connected to the atomizer 100, the charging interface 93 and the power indicator light 94 are electrically connected to the battery 92. Specifically, the number of the power indicator lights 94 is five. It can be understood that, in alternative embodiment not shown, the number of the power indicator lights 94 can be several, the several power indicator lights 94 are uniformly distributed. The power can be observed according to power indicator lights 94, when the power is running low, the battery 92 can be charged by the charging interface 93, it is convenient.

When the electronic cigarette 200 works, by a rotation of the operation portion 1912 of the air regulating ring 191, the overlapping area between the air intake portion 1911 and the air intake hole 1913 can be controlled, thus the air intake volume can be adjusted. As indicated by the arrow in FIG. 4, the air is mixed with the aerosol in the atomizing chamber after passing through the air intake hole 1913 and the air intake passage 19 successively, and then the air is inhaled by user after passing through the smoke outlet passage 15 and a mouth piece successively. By defining a plurality of oil guiding holes 5324 on the base seat 532, if only a negative pressure is existed in the air passage beneath the oil guiding hole 5324, the problem that the bubble generated by the oil pressure or liquid intake chokes the liquid intake hole will not occur. The blocking plate 39 is latched on the base portion 38, the blocking plate 39 and the base portion 38 cooperatively encloses and forms the second liquid gathering chamber 42, the first liquid gathering chamber 43 is formed between the latching plate 40 and the base portion 38. The blocking plate 39 not only facilitates for assembling and disassembling the sealing member 30, but also enables opposite sides of the sealing member 30 to form the liquid gathering chamber. When a user operates the atomizer, but does not inhale, the tobacco liquid is cooled rapidly to form a condensed liquid, and the liquid gathering chamber can be used to gather the condensed liquid and the tobacco liquid overflow from the sealing member 30, preventing the condensed liquid from leaking everywhere. The sealing member 30 is plugged in the sidewall of the atomizer 100, the sealing member 30 can be taken out of the sidewall of the atomizer 100. When the condensed liquid is accumulated to a certain extent, the sealing member 30 can be pulled out for a unification clean.

The embodiments described above are merely preferred embodiments, but not intended to limit the application. Any modifications, alternatives or improvements made within the principle and spirit of the present application should be interpreted as falling within the protection scope of the present application. The claims are not limited to the features or acts described above. Rather, the proper scope of the disclosure is defined by the appended claims.

What is claimed is:

1. An atomizer, comprising:

a heating mechanism;

a pair of electrode contact assemblies configured to connect to the heating mechanism and to a battery for providing electric drive for the heating mechanism;

a main housing having an opening; and a sealing member configured to be assembled within the main housing via the opening, wherein the heating mechanism comprises:

a heating member, wherein the heating member is a cylindrical heating strip and defines therein an airflow passage for airflow passing therethrough;

a liquid guiding member for absorbing and/or storing tobacco liquid for the heating member to perform an atomizing action; and a base seat, wherein both the heating member and the liquid guiding member are assembled to the base seat, wherein the liquid guiding member is wrapped around a periphery of the heating member, or, the heating member is wrapped around a periphery of the liquid guiding member, the heating member and the liquid guiding member are disposed in the base seat in a transverse state and extends along an axial direction of the heating member, and wherein the base seat defines an airflow intake hole on one side end thereof, and an airflow outlet hole on an opposite side end, and the airflow enters the airflow passage via the airflow intake hole and travels out of the airflow passage via the airflow outlet hole, and wherein the main housing defines a liquid storage chamber and a smoke outlet passage, the sealing member defines a liquid intake hole and a smoke outlet hole, which are in communication with the liquid storage chamber and the smoke outlet passage, respectively, the heating mechanism is assembled in the sealing member, the base seat forms an atomizing chamber therein, and the atomizing chamber is in communication with the liquid storage chamber and the smoke outlet passage.

2. The atomizer according to claim 1, wherein the smoke outlet passage is disposed parallel to the liquid storage chamber, the sealing member defines an opening port in communication with the opening of the main housing, an end of the heating mechanism is received in the sealing member, an opposite end of the heating mechanism is hermetically connected to the opening port.

3. The atomizer according to claim 2, wherein the base seat comprises a first end received in the sealing member and a second end hermetically connected to the opening port, the atomizing chamber cuts through the first end along an arranging direction of the liquid storage chamber and the smoke outlet passage, the heating member and the liquid guiding member are received in the atomizing chamber, and are aligned to and in communication with the liquid intake hole.

4. The atomizer according to claim 3, wherein the first end forms an assembly protrusion protruding from the second end, the assembly protrusion is detachably assembled in the liquid intake hole and defines a liquid intake port in communication with the liquid storage chamber and the atomizing chamber.

5. The atomizer according to claim 3, wherein the heating member and the liquid guiding member are assembled in atomizing chamber, one end of each of the pair of electrode contact assemblies are encapsulated in opposite ends of the atomizing chamber and are electrically connected to the heating member, and an opposite end of the each of the pair of electrode contact assemblies extends through and protrudes out of the first end of the base seat.

6. The atomizer according to claim 1, wherein the smoke outlet passage is in communication with the airflow passage via a smoke guiding portion.

7. The atomizer according to claim 6, wherein an end of the smoke guiding portion in communication with the airflow passage has an internal diameter greater than an internal diameter of the airflow passage.

8. The atomizer according to claim 7, wherein the smoke guiding portion is positioned between the sealing member and a peripheral circumferential wall of a side of the base seat adjacent to the smoke outlet passage, and is in communication with the smoke outlet passage and the atomizing chamber, one of the pair of electrode contact assemblies which is adjacent to the smoke guiding portion defines a first through hole in communication with the atomizing chamber and the smoke guiding portion.

9. The atomizer according to claim 8, wherein the main housing defines an air intake hole in communication with an air intake passage, a side of the sealing member adjacent to the liquid storage chamber defines an air intake port in communication with the air intake passage, one of the two electrode contact assemblies which is adjacent to the air intake port defines a second through hole in communication with the air intake port.

10. The atomizer according to claim 9, wherein the air intake hole is provided with an air regulating ring, the air regulating ring comprises an air intake portion and an operation portion which are spaced from each other, the air intake portion cuts through the air regulating ring and defines a ventilation port in communication with the air intake passage via the air intake hole.

11. The atomizer according to claim 9, wherein the air intake passage is disposed parallel with the smoke outlet passage and the liquid storage chamber, and the airflow passage of the heating member is disposed perpendicular to the air intake passage and the smoke outlet passage.

12. The atomizer according to claim 1, wherein an axial direction of the smoke outlet passage and an axial direction of the airflow passage defines an angle θ, the angle θ has a value in the range of 90 degrees to 180 degrees.

13. The atomizer according to claim 1, wherein the sealing member is made of silica gel.

14. An electronic cigarette, comprising:

the atomizer according to claim 1; and the battery electrically connected to the atomizer.

15. The electronic cigarette according to claim 14, wherein the battery or the atomizer is provided with an elastic latch, the atomizer or the battery defines a latching groove accordingly, for securing the atomizer to the battery.

16. The atomizer according to claim 1, wherein the base seat in the heating mechanism seat is made of a ceramic material.

* * * * *